US007841024B2

(12) United States Patent
Son

(10) Patent No.: US 7,841,024 B2
(45) Date of Patent: Nov. 30, 2010

(54) BACK FINGER PORTION FOR GLOVES

(75) Inventor: Yeong Chul Son, Gloversville, NY (US)

(73) Assignee: Swany America Corporation, Johnstown, NY (US)

( * ) Notice: Subject to any disclaimer, the term of this patent is extended or adjusted under 35 U.S.C. 154(b) by 452 days.

(21) Appl. No.: 11/791,186

(22) PCT Filed: Nov. 29, 2005

(86) PCT No.: PCT/US2005/042876

§ 371 (c)(1),
(2), (4) Date: Sep. 24, 2007

(87) PCT Pub. No.: WO2006/062751

PCT Pub. Date: Jun. 15, 2006

(65) Prior Publication Data

US 2008/0115256 A1 May 22, 2008

Related U.S. Application Data

(60) Provisional application No. 60/634,267, filed on Dec. 9, 2004.

(51) Int. Cl.
*A41D 19/00* (2006.01)

(52) U.S. Cl. ..... 2/163; 2/169

(58) Field of Classification Search ..... 2/163, 2/169

See application file for complete search history.

(56) References Cited

U.S. PATENT DOCUMENTS

| | | | | |
|---|---|---|---|---|
| 1,540,718 | A | | 6/1925 | Sturm |
| 1,666,023 | A | | 4/1928 | Sturm |
| 3,377,627 | A | | 4/1968 | Madnick |
| 3,548,414 | A | * | 12/1970 | Yuta ..... 2/169 |
| 4,000,524 | A | * | 1/1977 | Rinehart ..... 2/161.6 |
| 4,654,896 | A | * | 4/1987 | Rinehart ..... 2/163 |
| 4,831,667 | A | | 5/1989 | Town |
| 5,167,038 | A | | 12/1992 | Rinehart |
| 5,384,083 | A | | 1/1995 | Dawn et al. |
| 5,504,942 | A | | 4/1996 | Kuwahara |
| 5,857,216 | A | | 1/1999 | Gold |
| 7,062,791 | B2 | * | 6/2006 | Gold ..... 2/161.6 |
| 2003/0106133 | A1 | | 6/2003 | Novak |
| 2003/0208833 | A1 | | 11/2003 | Gold |

* cited by examiner

*Primary Examiner*—Katherine Moran
(74) *Attorney, Agent, or Firm*—Wenderoth, Lind & Ponack, L.L.P.

(57) ABSTRACT

This invention relates to a glove pattern design having back finger portions including two folds or tucks on each finger excluding the thumb. This pattern enables the glove to have a more natural finger curvature which is more comfortable to the wearer than the single fold or tuck pattern of the prior art. Furthermore, the tucks are formed differently from the prior art, by making V-shaped cuts into both opposing sides of the back finger parts where the tucks will be located. The tucks are secured by stitching where the V-shaped cuts are made, preferably along the length of the tuck from end to end. This additional step which is also novel in the prior art enables the tuck to be created in the glove at an angle that corresponds to the more natural curvature of the fingers in a relaxed position. This curving of the fingers provides the articulation necessary to have the glove conform to the natural position of the hand.

10 Claims, 8 Drawing Sheets

BACK FINGER PORTION FOR GLOVES

This application claims the benefit of U.S. provisional application Ser. No. 60/634,267 filed Dec. 9, 2004.

BACKGROUND OF THE INVENTION

1. Field of the Invention

This invention relates to a glove pattern design. More specifically, the invention relates to a novel back finger portion of a glove design. The design is applicable to any type of glove, for example work gloves and ski gloves.

2. Description of Related Art

U.S. Pat. No. 4,654,896 to Reinhart describes a glove pattern design with back finger portions including a single fold or tuck. The single fold or tuck is disposed at the first knuckle and is created by making the back finger part pattern slightly longer than the palm finger part pattern. The tuck is secured only at the ends, where the back finger portion is secured to the palm portion of the glove. The back finger pattern is a four pointed star shape with finger portions conforming to the shape of the individual fingers. As seen in FIG. 3 of the patent, the fingers of the glove are straight.

U.S. Pat. No. 5,504,942 to Kuwahara describes a glove containing an improved back finger portion using a modified four pointed star pattern and separate back finger tip parts connected to the modified star pattern. The glove pattern results in a glove having curved fingers corresponding to the natural curvature of the fingers of a hand.

BRIEF SUMMARY OF THE INVENTION

This invention relates to a glove pattern design having back finger portions including two folds or tucks on each finger excluding the thumb. This pattern enables the glove to have a more natural finger curvature which is more comfortable to the wearer than the single fold or tuck pattern of the prior alt. Furthermore, the tucks are formed differently from the prior art, by making V-shaped cuts into both opposing sides of the back finger parts where the tucks will be located. The tucks are secured by stitching where the V-shaped cuts are made, preferably along the length of the tuck from end to end. This additional step which is also novel in the prior art enables the tuck to be created in the glove at an angle that corresponds to the more natural curvature of the fingers in a relaxed position. This curving of the fingers provides the articulation necessary to have the glove conform to the natural position of the hand.

DETAILED DESCRIPTION OF THE PREFERRED EMBODIMENTS

Figure 1:
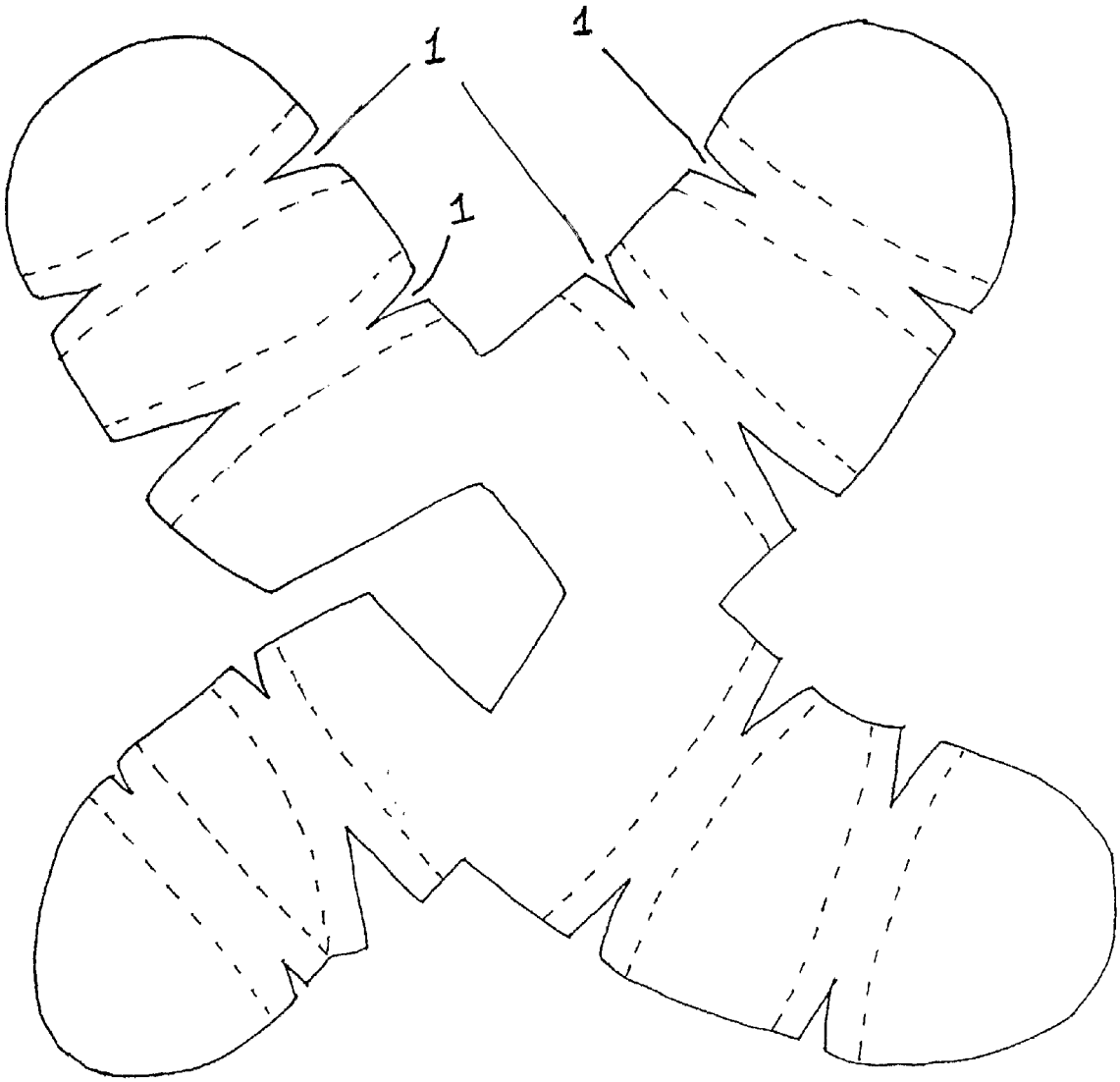
FIG. 1 is a plan view of a first embodiment of the back finger portion pattern of a glove according to the invention.

FIG. 1 is a plan view of the back finger portion pattern of this invention, showing two pairs of opposed V-shaped cuts 1 on each side of each of the four finger parts. The dashed lines illustrate where the tucks are secured, for example with a plurality of stitches.

Figure 2:
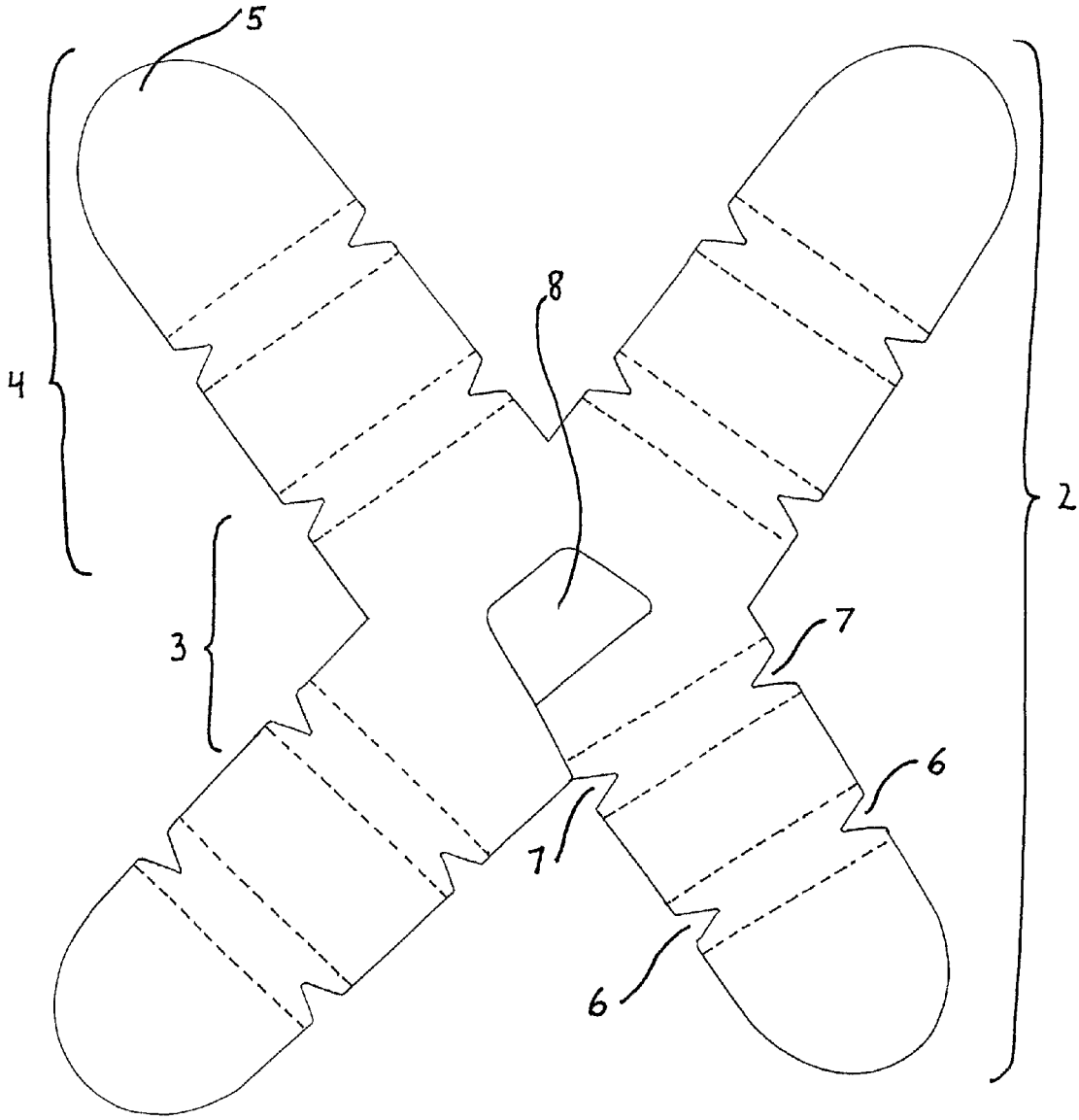
FIG. 2 is a plan view of a second embodiment of the back finger portion pattern thereof.

FIG. 2 is a plan view of another back finger portion pattern, showing a star pattern piece 2 comprising a center portion 3 and four radiating back finger parts 4 each having a distal tip end 5.

Each of the four back finger parts have a first pair of V-shaped cuts 6 on opposing edges of the four back finger parts. The first pair of V-shaped cuts are located near the distal tip end of the four back finger parts. The dashed lines illustrate where the tucks are secured, for example with a plurality of stitches.

Each of the four back finger parts further have a second pair of V-shaped cuts 7 on opposing edges of the four back finger parts. The second pair of V-shaped cuts are located between the first pair of V-shaped cuts and the center portion of the star pattern.

As shown in FIG. 2, the back finger portion of the glove of this invention is preferably a single piece of glove material. Alternatively, the back finger portion may be comprised of two or more pieces of glove material.

The back finger portion of the glove preferably has in the center portion of the star pattern an inner substantially rectangular shaped cut out 8.

Figure 3:
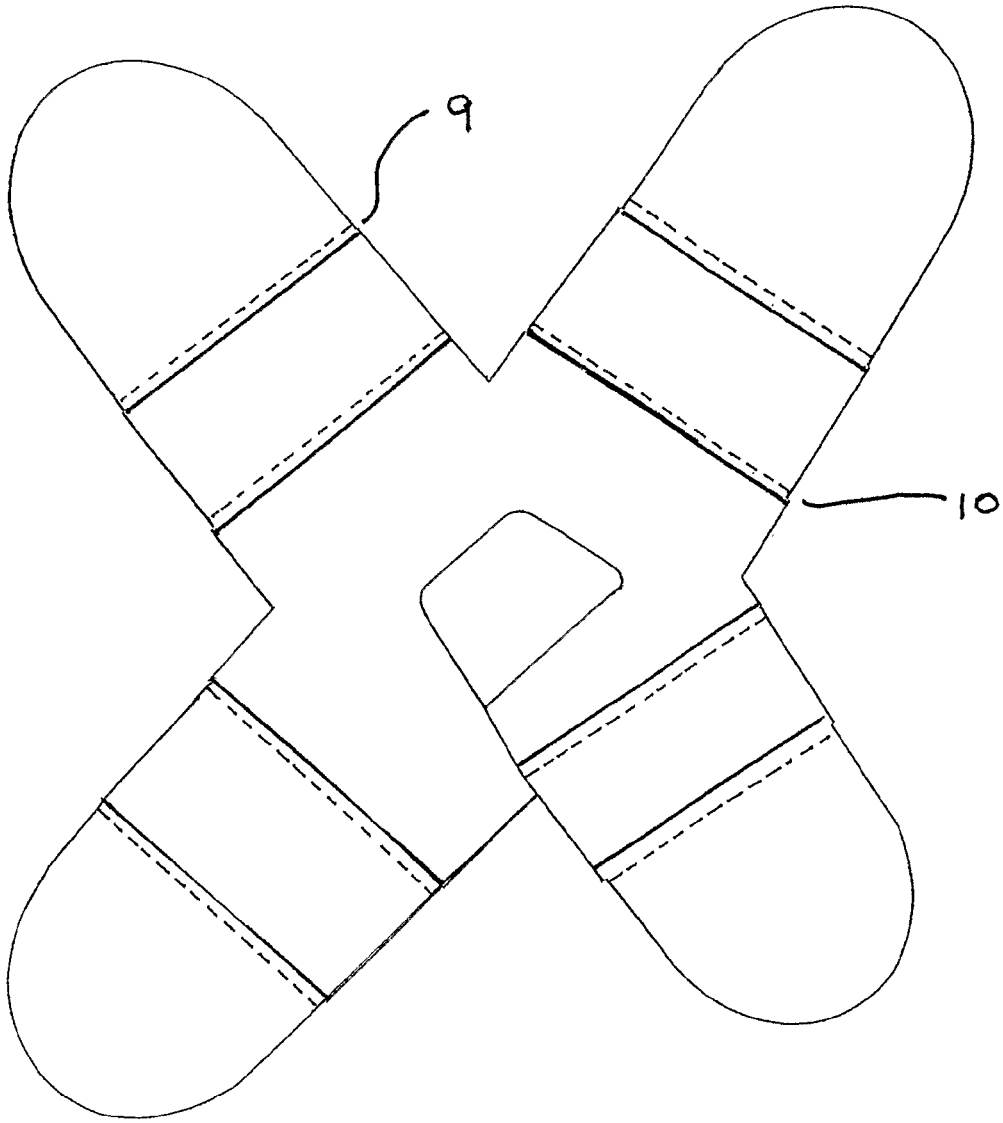
FIG. 3 is a plan view of the back finger portion pattern of the glove shown in FIG. 2, wherein the first and second finger tucks have been formed prior to glove assembly.

FIG. 3 is a plan view of the back finger portion of the glove shown in FIG. 2, wherein each back finger part is shortened by first and second tucks 9, 10 therein extending across the width of the finger part. The first tuck 9 comprises a portion of the finger part folded upon itself and is located at the first pair of V-shaped cuts 6. The second tuck 10 comprises a portion of the finger part folded upon itself and is located at the second pair of V-shaped cuts 7.

The first and second tucks of each finger part are secured with a plurality of stitches. Preferably the first and second tucks of each finger part are secured across the width of each finger part with a plurality of stitches.

There are three bones in each finger called the proximal phalanx, the middle phalanx and the distal phalanx. Each finger has three joints. The first joint is where the proximal phalanx of the finger joins the hand, or metacarpals. The second joint is where the proximal phalanx joins the middle phalanx. The third joint is where the middle phalanx joins the distal phalanx.

The first tuck of each finger part is located at a position corresponding to substantially the third joint connecting the middle and distal phalanges of the fingers of a wearer.

The second tuck of each finger part is located at a position corresponding to substantially the second joint connecting the proximal and middle phalanges of the fingers of a wearer.

This invention also comprises a glove assembly including the back finger portion of this invention as described above. The glove further comprises a back hand portion, a palm portion, four front finger portions, and a thumb portion. The back hand portion, palm portion, four front finger portions and thumb portion of the glove may be any conventional construction comprised of any conventional number of pieces.

Figure 4:
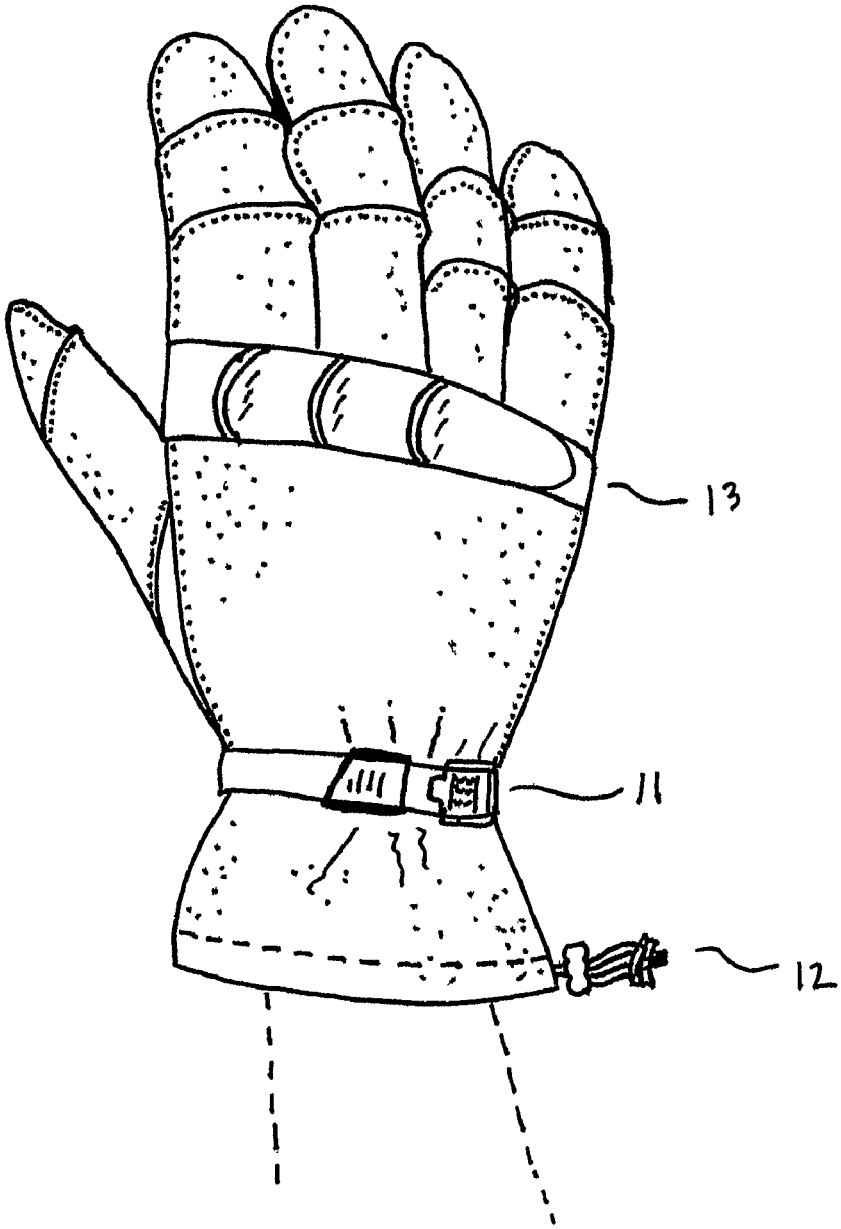
FIG. 4 shows a top view of a glove assembly according to this invention.

FIG. 4 shows a top view of a glove assembly according to this invention, which glove is a ski glove. The glove has an optional wrist strap 11 for tightening the glove around the wrist. The glove further has an optional tie string 12 which is sewn inside the opening of the glove for tightening the glove around the wrist or forearm area to prevent snow from entering the glove. The glove further has an optional strip of resilient material 13, such as rubber, overlying the knuckles for protection of the knuckles from injury.

Figure 5:
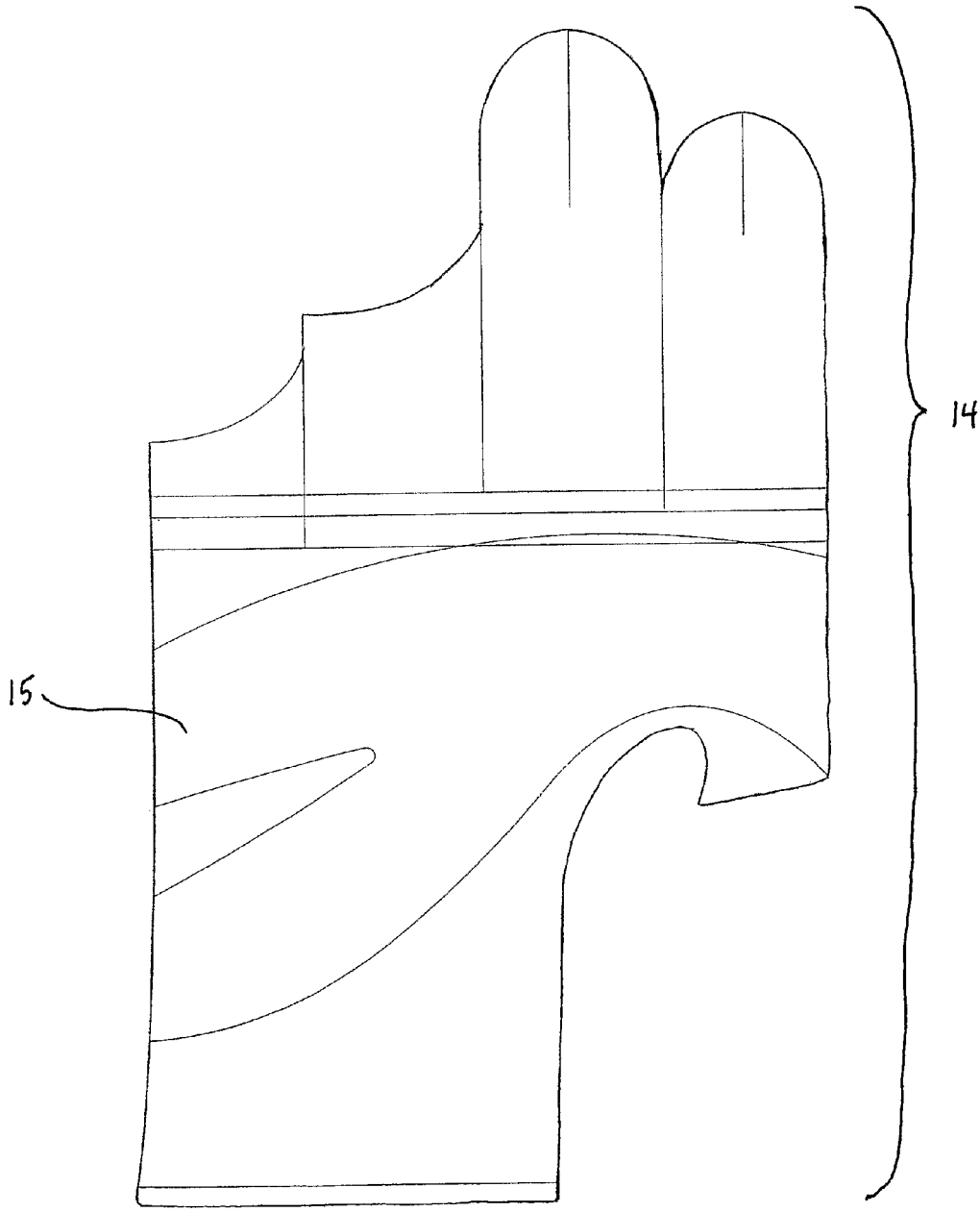
FIG. 5 is a plan view of a first embodiment of a single piece palm and front finger pattern.

FIG. 5 is a plan view of a single piece palm and front finger pattern 14. The tips of the fourth and fifth finger parts are cut from another piece of glove material as separate pieces and sewn to the palm and front finger pattern and the back finger pattern. In addition, FIG. 5 shows an optional palm reinforcement piece 15 which is joined to the palm and front finger pattern 14.

Figure 6:
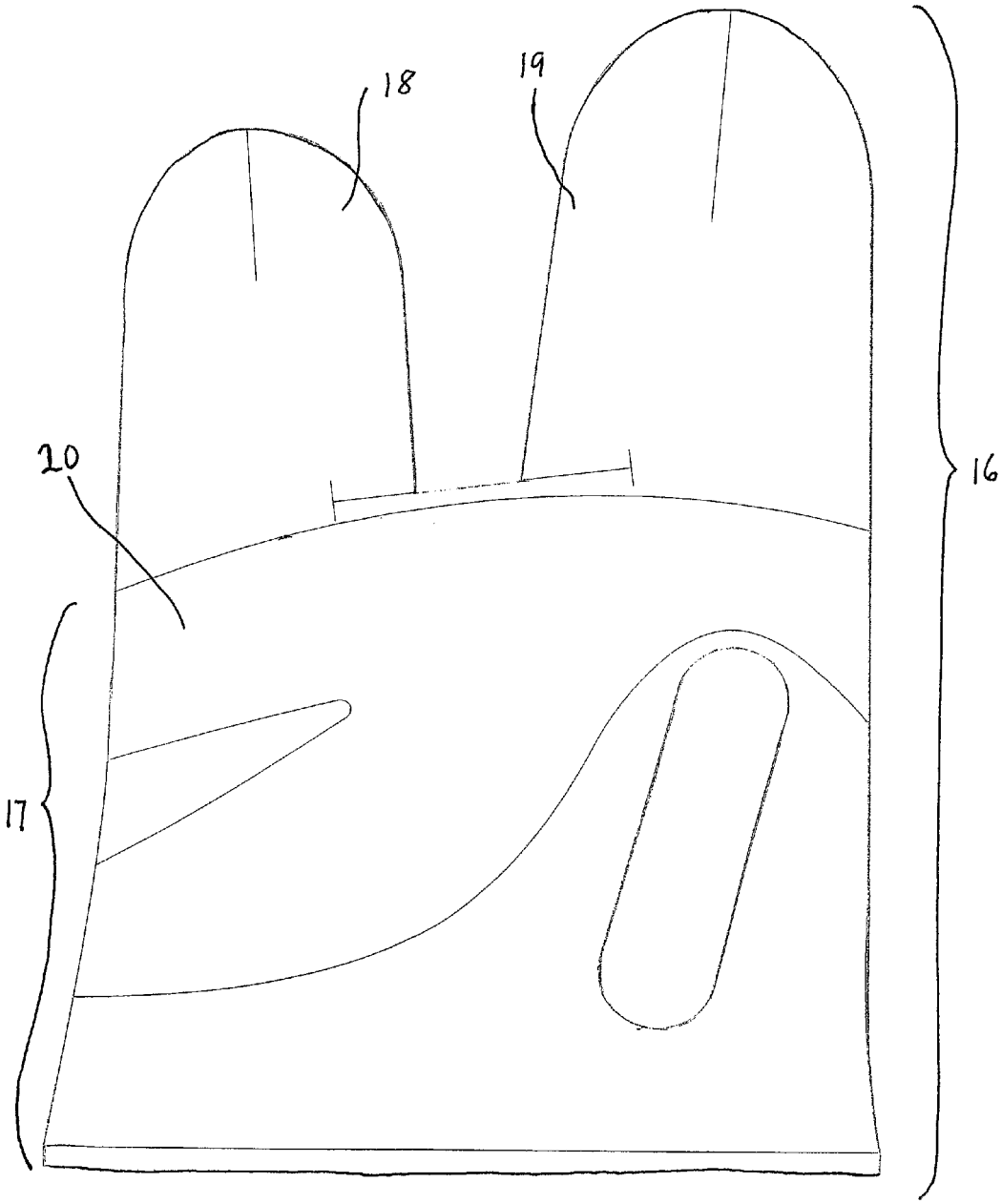
FIG. 6 is a plan view of a second embodiment of an alternative single piece palm and front finger pattern.

FIG. 6 is a plan view of an alternate single piece palm and front finger pattern 16. This pattern is used for construction of a glove assembly with a traditional Gunn cut pattern. The Gunn cut pattern features a single piece pattern for the palm 17, little (fifth) finger 18, and index (second) finger 19. The two center fingers (middle and ring, or third and fourth) are cut from another piece of glove material as a single piece and sewn to the palm and back finger portion. FIG. 6 shows an optional palm reinforcement piece 20 which is joined to the palm and front finger pattern 16.

Figure 7:
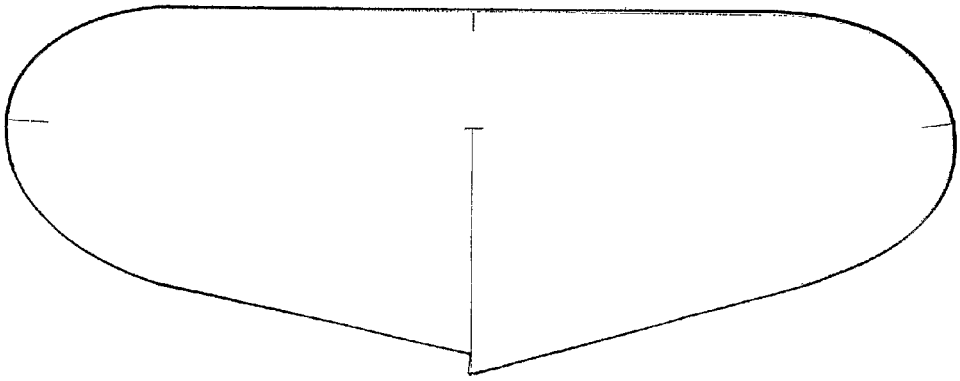
FIG. 7 is a plan view of a two center finger pattern for completing the palm and front finger pattern according to FIG. 6.

FIG. 7 is a plan view of the two center finger pattern for completing the palm and front finger pattern according to FIG. 6.

Figure 8:
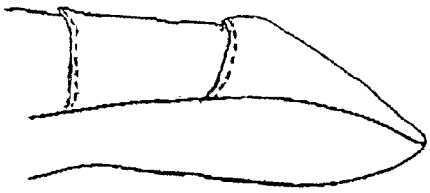
FIG. 8 is a side profile view of a first embodiment of a finger part of the back finger portion which has been sewn to the corresponding finger part of the front finger portion.

FIG. 8 is a side profile view of a first embodiment of a finger part of the back finger portion which has been sewn to the corresponding finger part of the front finger portion.

Figure 9:
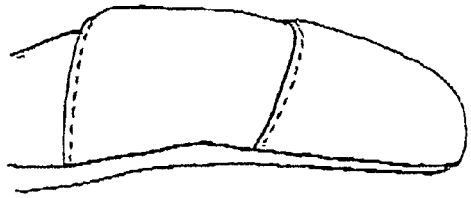
FIG. 9 is a side view of a second embodiment of an alternative side finger profile of the invention.

FIG. 9 is a side view of a second embodiment of an alternative side finger profile of the invention.

Figure 10:
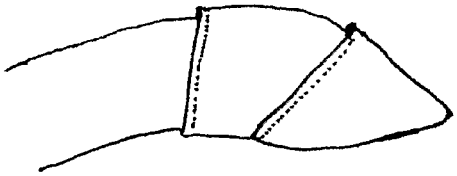
FIG. 10 is a side view of a third embodiment of another alternative side finger profile embodiment of the invention.

FIG. 10 is a side view of a third embodiment of another alternative side finger profile embodiment of the invention.

As seen in FIG. 8, FIG. 9 and FIG. 10, the finger parts of the glove may be constructed so that the location of the side seam of the finger parts varies in location along the height of the finger. The side seam may be varied by adjusting the width of the finger parts of the back finger portion and the front finger portion. In FIG. 8, the side seam runs along the middle of the finger. In FIG. 9, the side seam runs below the middle of the finger. In FIG. 10, the side seam is not visible.

Figure 11:
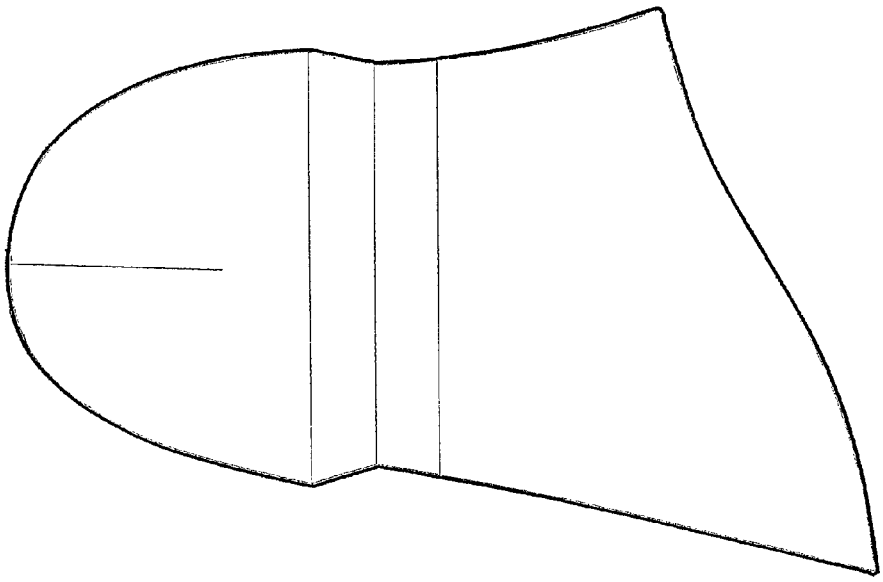
FIG. 11 is a plan view of a first embodiment of a thumb back finger pattern having a single pair of shallow V-shaped cuts.
Figure 12:
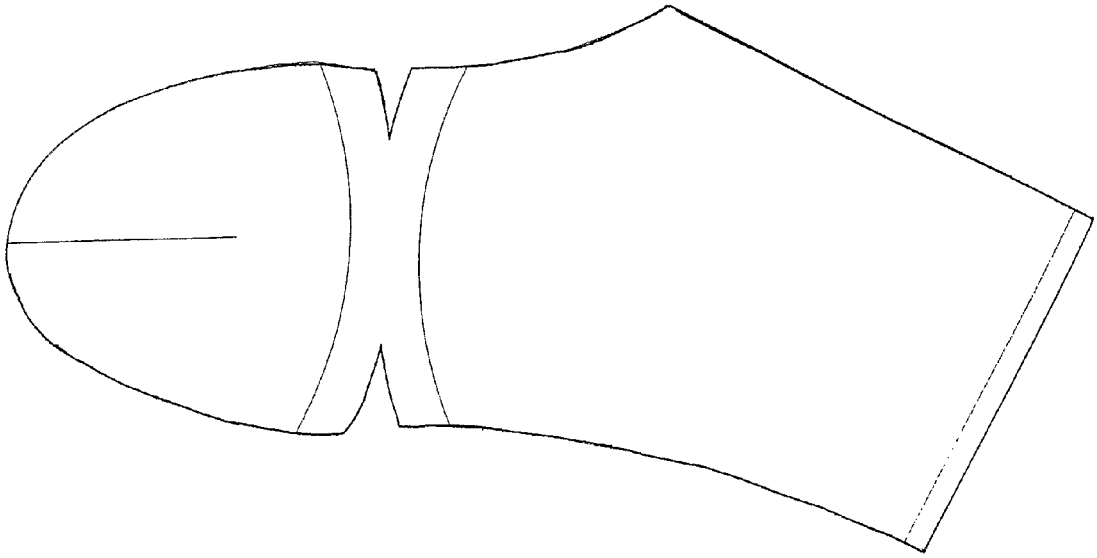
FIG. 12 is a plan view of a second embodiment of a thumb back finger pattern having a single pair of deeper V-shaped cuts.

The thumb may be constructed from any conventional pattern. Preferably the back of the thumb is constructed of a pattern as shown in FIG. 11 or FIG. 12. FIG. 11 is a plan view of a first embodiment of a thumb back finger pattern having a single pair of shallow V-shaped cuts. The lines illustrate the location where the single tuck is formed.

FIG. 12 is a plan view of a second embodiment of a thumb back finger pattern having a single pair of deeper V-shaped cuts. The embodiment of FIG. 12 is more closely similar to the V-shaped cuts of the back finger portion except that the thumb back finger pattern has a single tuck.

The glove may be made from any natural or synthetic material known in the art. Examples of natural materials are cotton and leather. Examples of synthetic materials are polyester and synthetic leather. The glove may be made from a single material or a plurality of materials. The glove may further include one or more inner layers, such as a waterproof layer, a water resistant layer, a moisture breathable layer, and/or a water absorbent layer. The one or more inner layers may be fixed to any layer of the glove, including the glove assembly of this invention, or such layers may be removable.

The glove assembly of this invention may be constructed according to any known conventional methods in the art, such as taught in the disclosures of U.S. Pat. Nos. 5,504,942 and 4,654,896, which patents are incorporated by reference herein.

It will be apparent to one skilled in the art that the foregoing description is presented for illustrative purposes, not by way of limitation, and that other alternative embodiments may be constructed within the scope of this invention for which protection by the patent issuing from this application is intended by the inventor.

I claim:

1. A back finger portion of a glove, comprising:

a star pattern piece comprising a center portion and four radiating back finger parts each having a distal tip end, each of the four back finger parts having a first pair of V-shaped cuts on opposing edges of the four back finger parts, the first pair of V-shaped cuts being located near the distal tip end of the four back finger parts, each of the four back finger parts further having a second pair of V-shaped cuts on opposing edges of the four back finger parts, the second pair of V-shaped cuts being located between the first pair of V-shaped cuts and the center portion of the star pattern, wherein each back finger part is shortened by first and second tucks therein extending across the width of the finger part, the first tuck comprising a portion of the finger part folded upon itself and being located at the first pair of V-shaped cuts, the second tuck comprising a portion of the finger part folded upon itself and being located at the second pair of V-shaped cuts.

2. The back finger portion of a glove according to claim 1, wherein the first and second tucks of each finger part are secured with a plurality of stitches.

3. The back finger portion of a glove according to claim 1, wherein the first and second tucks of each finger part are secured across the width of each finger part with a plurality of stitches.

4. The back finger portion of a glove according to claim 1, wherein the center portion of the star pattern has an inner substantially rectangular shaped cut out.

5. The back finger portion of a glove according to claim 1, wherein the star pattern piece comprising the center portion and the four radiating back finger parts are a single piece of glove material.

6. The back finger portion of a glove according to claim 1, wherein the first tuck of each finger part is located at a position corresponding to substantially the third joint connecting the middle and distal phalanges of the fingers of a wearer.

7. The back finger portion of a glove according to claim 1, wherein the second tuck of each finger part is located at a position corresponding to substantially the second joint connecting the proximal and middle phalanges of the fingers of a wearer.

8. A glove assembly, comprising the back finger portion according to claim 1.

9. The glove assembly according to claim 8, further comprising a back hand portion, a palm portion, four front finger portions, and a thumb portion.

10. The glove assembly according to claim 8, wherein the palm portion and four front finger portions are constructed in a Gunn cut pattern.

* * * * *